US010582301B2

(12) United States Patent
Hatta

(10) Patent No.: US 10,582,301 B2
(45) Date of Patent: Mar. 3, 2020

(54) SPEAKER DEVICE WITH DRONE CONES AND CURVED SUPPORT MEMBER

(71) Applicant: Jizai Design, LLC, Daito, Osaka (JP)

(72) Inventor: Atsushi Hatta, Daito (JP)

(73) Assignee: Jizai Design, LLC, Daito (JP)

( * ) Notice: Subject to any disclaimer, the term of this patent is extended or adjusted under 35 U.S.C. 154(b) by 0 days.

(21) Appl. No.: 16/097,936

(22) PCT Filed: Feb. 13, 2018

(86) PCT No.: PCT/JP2018/004790
§ 371 (c)(1),
(2) Date: Oct. 31, 2018

(87) PCT Pub. No.: WO2018/163719
PCT Pub. Date: Sep. 13, 2018

(65) Prior Publication Data

US 2019/0149923 A1 May 16, 2019

(30) Foreign Application Priority Data

Mar. 6, 2017 (JP) ..... 2017-041293

(51) Int. Cl.
*H04R 5/02* (2006.01)
*H04R 1/10* (2006.01)
(Continued)

(52) U.S. Cl.
CPC ..... *H04R 5/02* (2013.01); *H04R 1/10* (2013.01); *H04R 1/28* (2013.01); *H04R 1/2834* (2013.01);
(Continued)

(58) Field of Classification Search
CPC . H04R 1/00; H04R 1/026; H04R 1/10; H04R 1/28; H04R 1/283; H04R 5/02; H04R 2205/024
See application file for complete search history.

(56) References Cited

U.S. PATENT DOCUMENTS

2014/0126760 A1* 5/2014 Tse ..... H04R 5/02 381/334

FOREIGN PATENT DOCUMENTS

JP H06-178384 6/1994
JP 2008252421 A * 10/2008
(Continued)

OTHER PUBLICATIONS

English machine translation of WO 2016/039245 A1 (Minoda, Hidenori; Wearable Speaker Device; published Mar. 2016).*
(Continued)

*Primary Examiner* — Mark Fischer
(74) *Attorney, Agent, or Firm* — Harness, Dickey & Pierce, P.L.C.

(57) ABSTRACT

A speaker device comprises a curved support member having a U shape, housings provided on both sides of the curved support member, and speaker units attached to the front surfaces of the housings, wherein the curved support member is hollow such that the insides of the housings on both sides are in communication with each other, and include drone cones at its ends, and the drone cones are configured to vibrate by receiving on the back surface side a sound wave output from the back surface side of the speaker units, and output a sound from the front surface side.

20 Claims, 6 Drawing Sheets

(51) Int. Cl.
*H04R 1/28* (2006.01)
*H04R 1/02* (2006.01)

(52) U.S. Cl.
CPC ..... *H04R 1/026* (2013.01); *H04R 2201/023* (2013.01); *H04R 2205/024* (2013.01)

(56) References Cited

FOREIGN PATENT DOCUMENTS

| | | | |
|---|---|---|---|
| JP | 2010-178006 | | 8/2010 |
| JP | 2014027634 A | * | 2/2014 |
| JP | 2014-225752 | | 12/2014 |
| WO | WO-2016/039245 | | 3/2016 |

OTHER PUBLICATIONS

International Search Report dated May 29, 2018 in International Application No. PCT/JP2018/004790.

* cited by examiner

SPEAKER DEVICE WITH DRONE CONES AND CURVED SUPPORT MEMBER

CROSS-REFERENCE TO RELATED APPLICATIONS

This application is a National Stage Application of International Application No. PCT/JP2018/004790, filed Feb. 13, 2018, which claims priority to Japanese Application No. 2017-041293, filed on Mar. 6, 2017, the entire contents of each of which are incorporated herein by reference.

TECHNICAL FIELD

The present invention relates to a speaker device, and more specifically a speaker device that a user can use by wearing it around the neck.

BACKGROUND ART

To date, headphones and earphones are widely used as devices for listening to voice and music reproduced by sound-reproducing systems. Headphones and earphones are easily carried around together with portable players and therefore can be used even when moving, outdoors, or the like, but since external sound is mostly blocked when they are worn on both ears, the possibility of accidents likely increases during walking, cycling, or the like.

Accordingly, wearable neck speakers are known that are worn not directly on the ears but around the neck of a user, with speakers being disposed in the vicinity of both ears. For example, Patent Literature 1 discloses a neck speaker device configured such that housings each having a speaker are attached to both sides of a neck strap to position, in front of a user, an acoustic image formed by a sound emitted from the sound outlets of the housings. A bass reflex port is formed in the side surface of each housing to improve bass reproduction.

CITATION LIST

Patent Literature

Patent Literature 1: JP H6-178384 A

SUMMARY OF INVENTION

Technical Problem

In the device disclosed in Patent Literature 1, Helmholtz resonance is utilized for the reproduction of base from the housings. The Helmholtz resonance frequency can be determined based on the inner volume of the housings, the shape and size of the bass reflex ports, and the like, but since the housing size becomes excessively large in order to perform good bass reproduction, the device of Patent Literature 1 is problematic with respect to practicality.

Moreover, only the two housings perform sound reproduction and are involved in acoustic location and, therefore, there is also a problem in that the stereophonic effect is poor, and a natural realistic sensation and surround sensation are unlikely to be obtained.

Accordingly, an object of the present invention is to provide a speaker device capable of sound reproduction with an excellent realistic sensation by using a simple configuration.

Solution to Problem

The object of the present invention is achieved by a speaker device comprising a curved support member having a U shape, housings provided on both sides of the support member, and speaker units attached to front surfaces of the housings, wherein the support member is hollow such that insides of the housings on both sides are in communication with each other, and includes a drone cone at each end or inside, and the drone cone is disposed so as to be vibrated by receiving on a back surface side a sound wave output from a back surface side of the speaker units, and output a sound from a front surface side.

It is preferable that in the speaker device, the support member has a sound outlet on the front surface side of the drone cone. It is preferable that the sound outlet includes a shutter capable of varying a size of an opening area. A plurality of sound outlets may be formed and a plurality of drone cones may be provided so as to cover the respective sound outlets, and in this case it is preferable that the drone cones each have a different resonance frequency.

Moreover, it is preferable that the support member is extendable, contractible, and deformable.

Advantageous Effects of Invention

The present invention can provide a speaker device capable of sound reproduction with an excellent realistic sensation by using a simple configuration.

DESCRIPTION OF EMBODIMENTS

Figure 1:
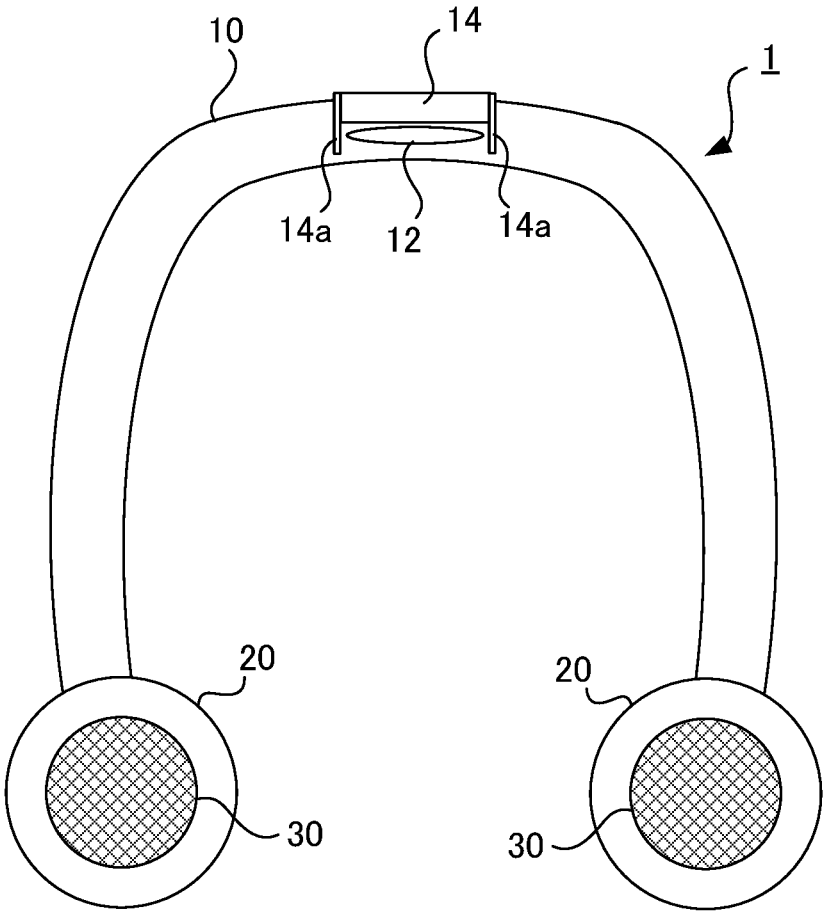
FIG. 1 is a plan view of a speaker device according to one embodiment of the present invention.
Figure 2:
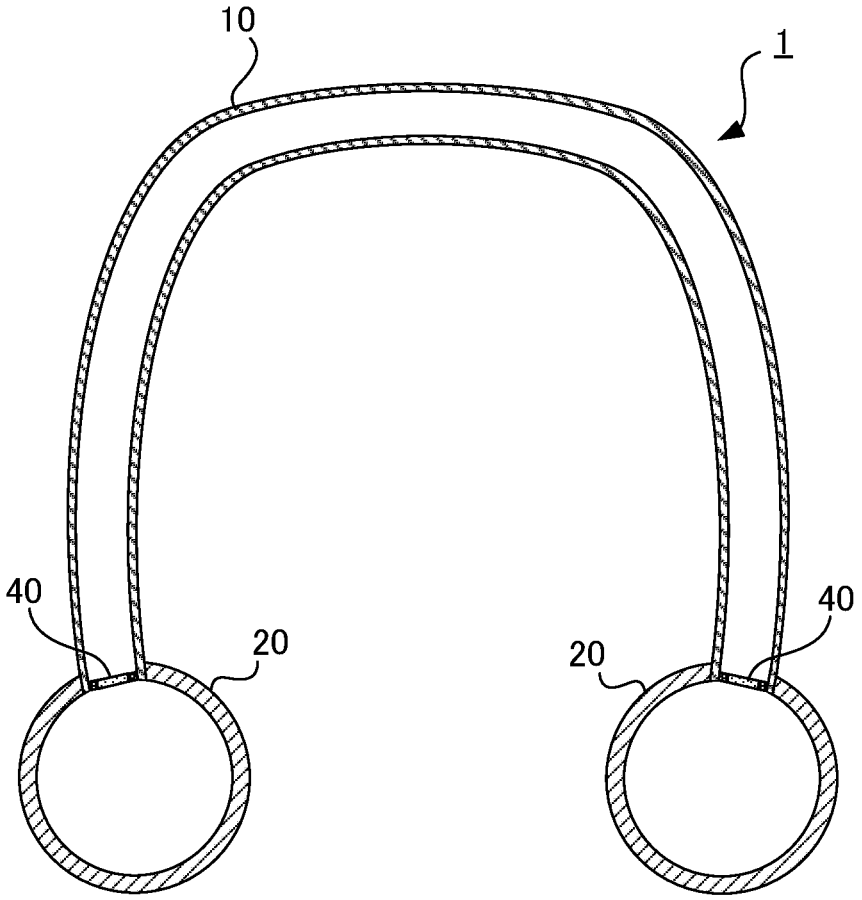
FIG. 2 is a cross-sectional view of the speaker device shown in FIG. 1.

Below, an embodiment of the present invention will now be described with reference to the attached drawings. FIG. 1 is a plan view of a speaker device according to one embodiment of the present invention as viewed from the front surface side, and FIG. 2 is a cross-sectional view of the speaker device shown in FIG. 1. As shown in FIGS. 1 and 2, the speaker device 1 includes a support member 10, hermetically closable housings 20, 20 one provided on both sides of the support member 10, speaker units 30, 30 attached to the housings 20, 20, and drone cones 40, 40 one provided at both ends of the support member 10. The support member 10 and the housings 20 are formed of, for example, synthetic resin or the like.

The support member 10 has a shape created by bending the both sides of a hollow cylinder into a U shape. Both ends are connected to the housings 20, 20, and thereby the insides of the housings 20, 20 on both sides are in communication with each other via the support member 10. An elongated sound outlet 12 is formed in the center on the front surface side of the support member 10. The sound outlet 12 is configured to have a variable opening area by using a slidable shutter 14, the opposite ends of which are supported by guide rails 14*a*, 14*a* and which slides over the outer circumferential surface of the support member 10. Preferably the support member 10 can be worn around the neck of a user, but is not necessarily limited to neck-wearing applications. For example, the support member 10 may be fastened to the collar with a pin, button, hook, or the like.

The speaker unit 30 has a known configuration for generating a sound by vibrating a diaphragm based on an audio signal that is input via wired or radio communication. The speaker unit 30 is attached on the front surface side of the housing 20 and outputs sound waves having mutually opposite phases toward the front side and the inside of the housing 20.

The drone cone 40 has the same configuration as the speaker unit 30 except for not having drivers, and has a rubber ring around a diaphragm to yield a specific resonance frequency. The drone cone 40 is disposed at the end of the support member 10 such that the inside of the housing 20 becomes a hermetically closed space, and the back surface side of the drone cone 40 receives sound waves output from the speaker unit 30 to the inside of the housing 20. When the sound waves contain a frequency component that matches the resonance frequency, the drone cone 40 resonates and outputs a sound having a specific resonance frequency from the front surface side of the drone cone 40 to the inside of the support member 10.

As for the speaker device 1 having the above-described configuration, when a user wears the support member 10 around the neck, the housings 20, 20 are disposed in the vicinity of the user's collarbones, with the sound outlet 12 of the support member 10 and the speaker units 30, 30 facing diagonally forward and upward. In this state, actuating the speaker units 30, 30 to input an audio signal causes a stereophonic sound to be output from the front surfaces of the speaker units 30, 30.

Moreover, in response to a sound that is output from the back surfaces of the speaker units 30, 30, the drone cones 40, 40 output sound waves having a specific resonance frequency to the inside of the support member 10. In this way, bass corresponding to the resonance frequency of the drone cones 40, 40 is output from the sound outlet 12 of the support member 10 to the vicinity of the back of the user's head. The resonance frequencies of the drone cones 40, 40 on both sides are set at the same value in the present embodiment, but may be mutually different. The volume of the sound output from the sound outlet 12 can be adjusted by operating the shutter 14 to control the opening area of the sound outlet 12.

Thus, according to the speaker device 1 of the present embodiment as with conventional wearable neck speakers, the acoustic location of the sound output from the front surfaces of the speaker units 30, 30 is in the vicinity of both of a user's ears toward the front and, also, the bass from the drone cones 40, 40 is output from behind the user's head and can supplement the acoustic output of the speaker units 30, 30 toward the front surface side. Therefore, despite the simple and power-saving configuration, the speaker device 1 can reproduce sound with an excellent realistic sensation, and can be suitably used for watching movie, listening to music, and the like. The drone cone approach employed in the speaker device 1 of the present embodiment makes it easier to reduce the size than the bass reflex approach, and a desired resonance frequency can be easily obtained. Moreover, an active element such as a woofer is not required, and thus a cost reduction can be achieved.

Moreover, as with conventional wearable neck speakers, the speaker units 30, 30 are disposed in front of a user, accordingly the center of gravity of the speaker device 1 is also located in front of the user, thus stability can be attained during use, and since both ears are not covered, the speaker device 1 can be used safely also during walking and cycling.

One embodiment of the present invention has been described in detail above, but the specific aspects of the present invention are not limited to the above embodiment. For example, in the embodiment described above, a single sound outlet 12 is formed in the support member 10, but a plurality of sound outlets 12 may be formed in the longitudinal direction of the support member 10. Alternatively, it is also possible to not form any sound outlet 12 in the support member 20 at all, and the speaker device 1 may be configured such that a user senses the output of sound waves from the drone cones 40, 40 primarily through vibrations of the support member 20.

Figure 3:
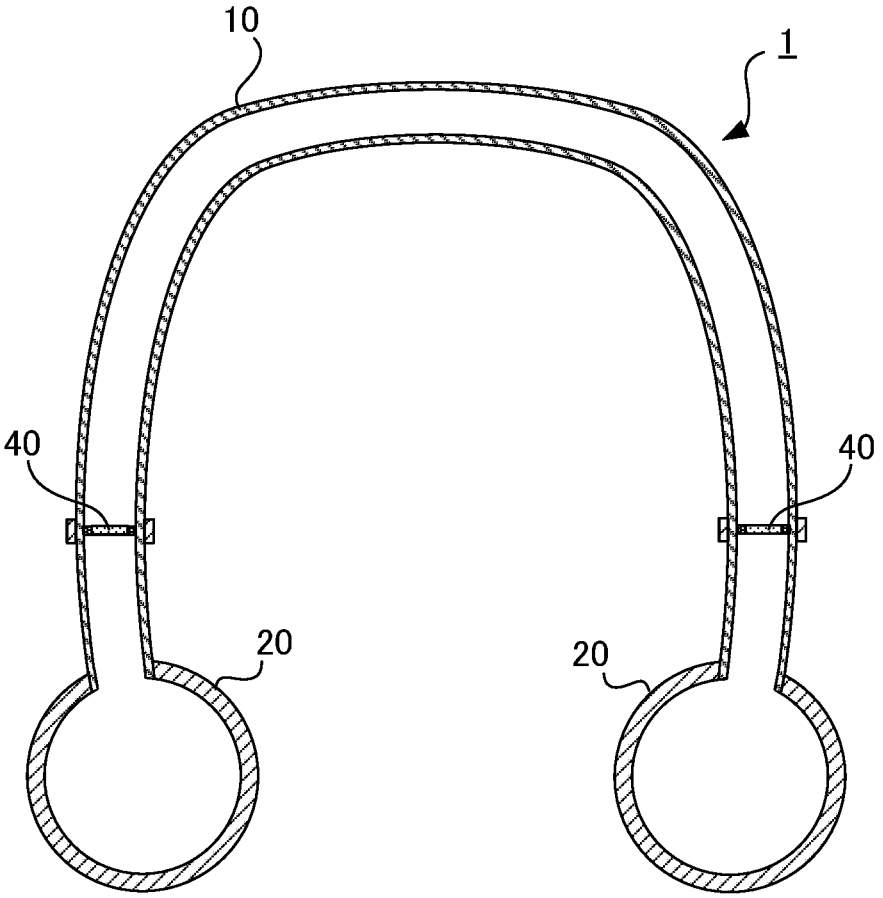
FIG. 3 is a cross-sectional view of a speaker device according to another embodiment of the present invention.

It is not necessarily required to dispose the drone cones 40, 40 at the ends of the support member 10 as in the embodiment described above. For example, the drone cones 40, 40 may be disposed in the intermediate parts on both sides of the support member 10 as shown in FIG. 3. The sound outlet 12 of the speaker device 1 shown in FIG. 3 is formed between the drone cones 40, 40 in the side wall of the support member 10.

Figure 4:
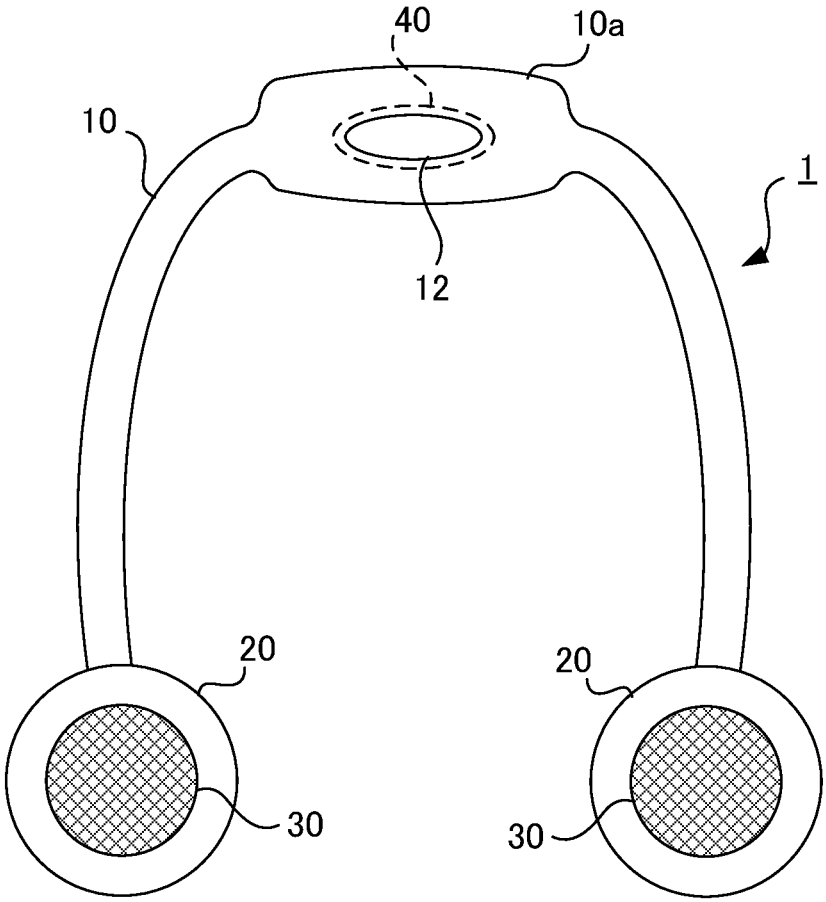
FIG. 4 is a plan view of a speaker device according to yet another embodiment of the present invention.

Moreover, as shown in FIG. 4, the drone cone 40 may be disposed so as to cover the sound outlet 12 from the inside of the support member 10. This configuration enables the inside of the speaker device 1 including the hollow part of the support member 10 as well as the inner spaces of the housings 20, 20 to be an entirely hermetically closed space, and disposing the drone cone 40 so as to correspond to the sound outlet 12 enables a bass sound to be output from the front surface of the drone cone 40 to the outside of the support member 10 via the sound outlet 12. According to this configuration, there may be a single drone cone 40 and, therefore, a further cost reduction can be achieved. The cross-sectional opening area of the support member 10 is preferably as small as possible such that good spring properties of the air inside the hermetically closed space can be obtained, and the cross-sectional opening area of the support member 10 may be suitably set also in consideration of the resonance frequency of the support member 10.

Figure 5:
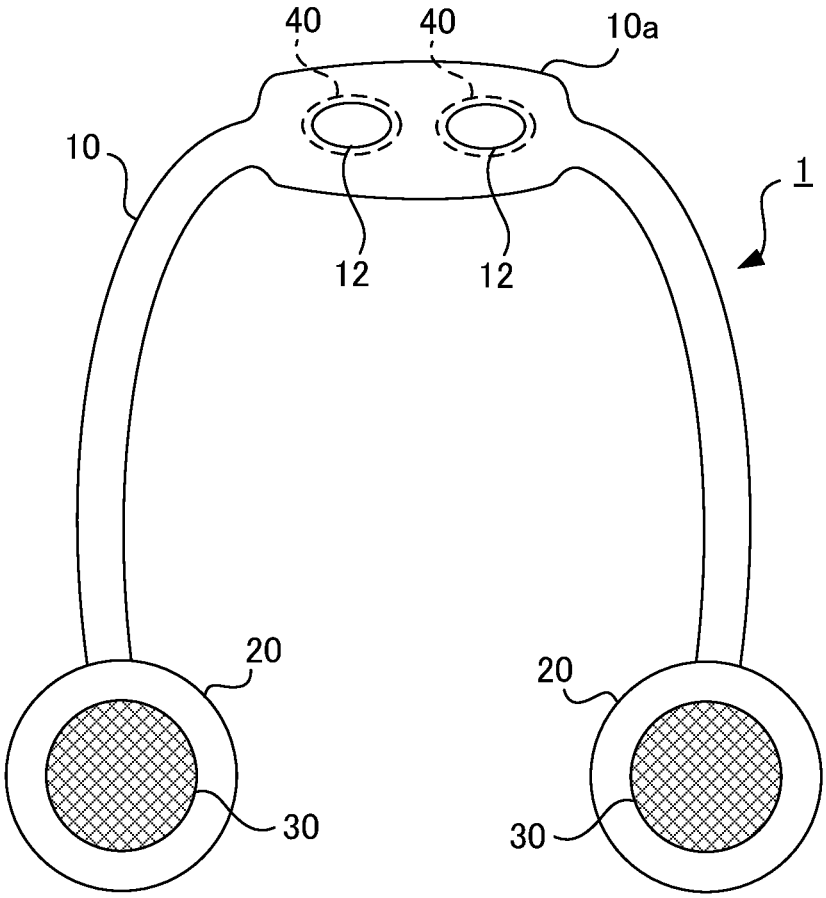
FIG. 5 is a plan view of a speaker device according to yet another embodiment of the present invention.

Moreover, as shown in FIG. 5, a plurality of sound outlets 12 (two in FIG. 5, but possibly three or more) may be formed and, as in the configuration shown in FIG. 4, the corresponding drone cone 40 may be disposed around each sound outlet 12. In this configuration, the specific resonance frequencies of the drone cones 40 disposed so as to correspond to the sound outputs 12 may be mutually different, and thereby it is possible to extend the bass band of a sound that is output from the support member 10 and thus further enhance a realistic sensation. A component similar to the shutter 14 shown in FIG. 1 may be attached to each sound outlet 12 to enable the opening areas to be individually adjusted.

The speaker device 1 of the above-described embodiments has the support member 10 that is already in a U shape, but the support member 10 may be configured to be extendable, contractible, and deformable, for example, by partially or entirely using pleated bellows for the support member 10. According to this configuration, the speaker device 1 can be used by being worn around the neck as with the speaker device 1 of the above-described embodiments, and can also be used as a stationary speaker device by linearly extending the support member 10.

Figure 6:
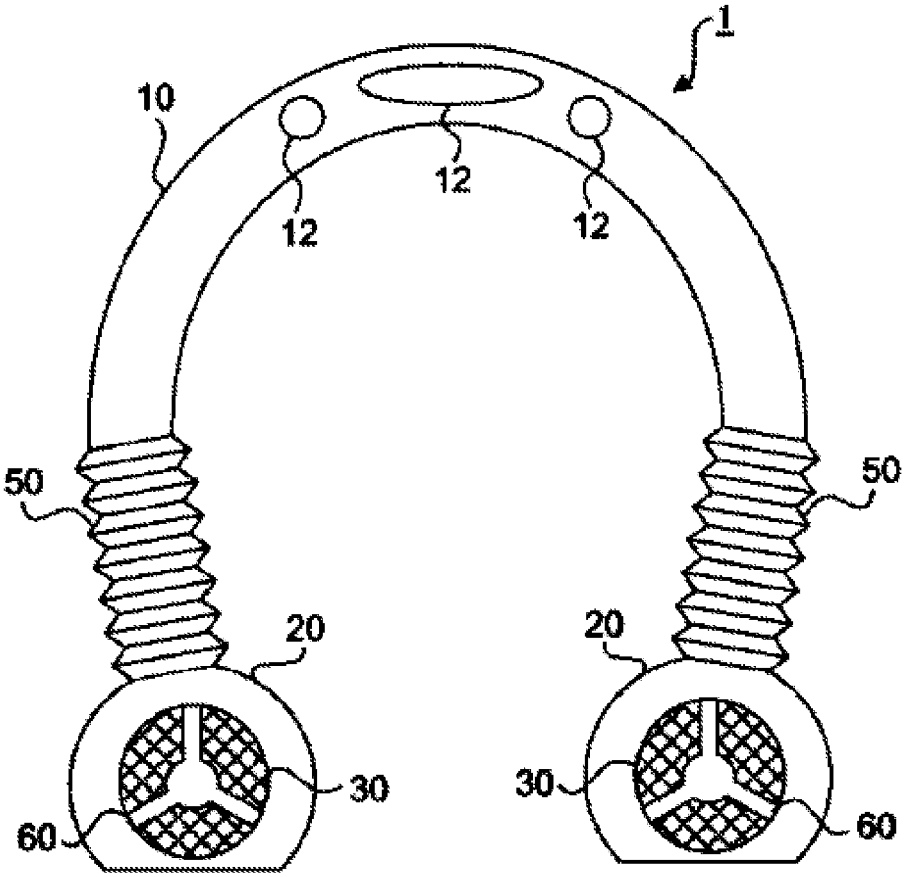
FIG. 6 is a plan view of a speaker device according to yet another embodiment of the present invention.

Moreover, the sound outlets 12 may be formed into a slot shape or a circular shape as shown in FIG. 6. According to this configuration, the acoustic characteristics of the output from the support member 10 may be suitably set by the position, shape, and number of the sound outlets 12.

Moreover, as shown in FIG. 6, the support member 10 may be partially composed of cylindrical pleated bellows 50.

Moreover, the right and left speaker units shown in FIG. 6 have flat bottoms. According to this configuration, the speaker units can stand on a desk or the like without being worn around the neck, and can be used as small stationary speakers.

Moreover, as shown in FIG. 6, protective grills for protecting the speaker units may be disposed on the front surfaces of the speaker units. This configuration can prevent a finger or the like from accidentally touching and damaging the speaker units. A meshed protective grill may be used.

REFERENCE SIGNS LIST

1 Speaker device
10 Support member
12 Sound outlet
14 Shutter
20 Housing
30 Speaker unit
40 Drone cone
50 Pleated bellows
60 Protective grill

The invention claimed is:

1. A speaker device comprising:
a curved support member having a U shape;
housings provided on sides of the curved support member; and
speaker units attached to front surfaces of the housings, wherein
the curved support member is hollow such that insides of the housings are in communication with each other, and the curved support member includes a drone cone at each end,
each drone cone is configured to
vibrate in response to receiving, at a back surface side, a sound wave output from a back surface side of a corresponding speaker unit, and
output a sound from a front surface side to the inside of the curved support member, and
the curved support member has a sound outlet at a center of a front surface side thereof.

2. The speaker device according to claim 1, wherein the sound outlet includes a shutter configured to vary a size of an opening area of the sound outlet.

3. The speaker device according to claim 1, wherein the curved support member is at least one of extendable, contractible or deformable.

4. The speaker device according to claim 1, wherein the sound outlet is elongated.

5. A speaker device comprising:
a curved support member having at least one sound outlet at a center portion thereof;
a first housing at a first end of the curved support member;
a first speaker unit attached to a surface of the first housing;
a first drone cone at the first end of the curved support member, the first drone cone separating an inside of the first housing from an inside of the curved support member, and the first drone cone configured to
vibrate in response to receiving a sound wave output from the first speaker unit at a first surface side of the first drone cone, and
output a sound within the curved support member from a second surface side of the first drone cone;
a second housing at a second end of the curved support member;
a second speaker unit attached to a surface of the second housing; and
a second drone cone at the second end of the curved support member, the second drone cone separating an inside of the second housing from the inside of the curved support member, and the second drone cone configured to
vibrate in response to receiving a sound wave output from the second speaker unit at a first surface side of the second drone cone, and
output a sound within the curved support member from a second surface side of the second drone cone.

6. The speaker device of claim 5, wherein the inside of the first housing is in communication with the inside of the second housing through the curved support member.

7. The speaker device according to claim 5, further comprising:
a shutter configured to vary a size of an opening of the at least one sound outlet.

8. The speaker device according to claim 5, wherein the curved support member is configured to be at least one of extended or contracted.

9. The speaker device according to claim 5, wherein the curved support member is deformable.

10. The speaker device according to claim 5, wherein the at least one sound outlet is elongated.

11. The speaker device according to claim 5, wherein
the first drone cone is configured to hermetically seal the inside of the first housing, and
the second drone cone is configured to hermetically seal the inside of the second housing.

12. The speaker device according to claim 5, wherein the curved support member has a plurality of sound outlets at the center portion thereof.

13. The speaker device according to claim 5, wherein the curved support member is U shaped.

14. A speaker device comprising:
a curved support member having at least one sound outlet at a center portion thereof;
a first housing at a first end of the curved support member;
a first speaker unit attached to a surface of the first housing;
a first drone cone within the curved support member between the at least one sound outlet and the first housing, the first drone cone configured to
vibrate in response to receiving a sound wave output from the first speaker unit at a first surface side of the first drone cone, and
output a sound within the curved support member from a second surface side of the first drone cone;
a second housing at a second end of the curved support member;
a second speaker unit attached to a surface of the second housing; and
a second drone cone within the curved support member between the at least one sound outlet and the second housing, the second drone cone configured to
vibrate in response to receiving a sound wave output from the second speaker unit at a first surface side of the second drone cone, and output a sound within the curved support member from a second surface side of the second drone cone.

15. The speaker device of claim 14, wherein an inside of the first housing is in communication with an inside of the second housing through the curved support member.

16. The speaker device according to claim 14, further comprising:

a shutter configured to vary a size of an opening of the at least one sound outlet.

17. The speaker device according to claim 14, wherein the curved support member is configured to be at least one of extended or contracted.

18. The speaker device according to claim 14, wherein the curved support member is deformable.

19. The speaker device according to claim 14, wherein the first drone cone is configured to hermetically seal an inside of the first housing, and the second drone cone is configured to hermetically seal an inside of the second housing.

20. The speaker device according to claim 14, wherein the curved support member is U shaped.

* * * * *